US011933033B2

(12) United States Patent
Larach

(10) Patent No.: US 11,933,033 B2
(45) Date of Patent: Mar. 19, 2024

(54) UNDERGROUND WATER TANKS USING MODULAR CRATES

(71) Applicant: Oscar E Larach, Castlecrag (AU)

(72) Inventor: Oscar E Larach, Castlecrag (AU)

( * ) Notice: Subject to any disclaimer, the term of this patent is extended or adjusted under 35 U.S.C. 154(b) by 0 days.

(21) Appl. No.: 17/893,536

(22) Filed: Aug. 23, 2022

(65) Prior Publication Data

US 2023/0056371 A1 Feb. 23, 2023

Related U.S. Application Data

(60) Provisional application No. 63/236,078, filed on Aug. 23, 2021.

(51) Int. Cl.
*E03F 1/00* (2006.01)
*E03B 11/14* (2006.01)

(52) U.S. Cl.
CPC ..... *E03F 1/005* (2013.01); *E03B 11/14* (2013.01)

(58) Field of Classification Search
CPC ..... E03F 1/002; E03F 1/005; E03B 11/14
See application file for complete search history.

(56) References Cited

U.S. PATENT DOCUMENTS 7,591,610 B2 * 9/2009 Krichten ..... E03F 1/005 405/53
7,704,011 B2 * 4/2010 Marshall ..... E03F 1/005 404/34
8,123,436 B2 * 2/2012 Larach ..... E03F 1/005 405/36
8,790,037 B2 * 7/2014 Culleton ..... E01C 3/006 404/34
9,079,708 B2 * 7/2015 Takai ..... E03F 1/002
9,506,235 B2 * 11/2016 Adams ..... E03F 1/005
10,238,084 B2 * 3/2019 van Raam ..... B25J 11/0085
10,285,339 B2 * 5/2019 Ray ..... E01C 9/005
10,415,260 B2 * 9/2019 Gooden ..... E01C 11/185
(Continued)

FOREIGN PATENT DOCUMENTS

KR 200466359 Y1 * 4/2013

OTHER PUBLICATIONS

International Search Report and Written Opinion dated Nov. 21, 2022 in corresponding International Application No. PCT/US22/41277; 9 pages.

*Primary Examiner* — Frederick L Lagman
(74) *Attorney, Agent, or Firm* — Plager Schack LLP; Mark H. Plager; Kara Verryt

(57) ABSTRACT

An underground infiltration crate for collecting, detaining, infiltrating, and storing grey water, rainwater, and/or storm water, may include a plurality of large plates attached to a plurality of small plates engaged to form a crate with tubular members positioned therein, wherein each tubular member is secured between a pair of large plates. Each of the large plates may be a framed panel that includes a four-sided periphery formed of a top periphery wall, a bottom periphery wall, and two side periphery walls; alternating parallel channels extending between the top periphery wall and the bottom periphery wall; at least one aperture extending through each of the alternating parallel channels; and at least one built in fitting integrated into the framed panel, wherein the built in fitting may be a ring-shaped groove that is sized to friction fit a tubular member therein.

8 Claims, 5 Drawing Sheets

(56) References Cited

U.S. PATENT DOCUMENTS

| | | | | |
|---|---|---|---|---|
| 10,718,090 | B2 * | 7/2020 | van Raam | A01K 1/0151 |
| 10,808,390 | B2 * | 10/2020 | Van Der Scheer | E02B 11/005 |
| 10,808,392 | B2 * | 10/2020 | Bhatia | E03F 1/005 |
| 11,369,065 | B2 * | 6/2022 | Ray | A01G 13/0237 |
| 11,492,793 | B2 * | 11/2022 | Kulick, III | E03F 1/002 |
| 2010/0021236 | A1 * | 1/2010 | Kreikemeier | E03F 1/005 405/55 |
| 2010/0200600 | A1 * | 8/2010 | Hoekstra | E03F 1/005 220/676 |
| 2011/0044760 | A1 | 2/2011 | Larach | |
| 2013/0152499 | A1 | 6/2013 | Kriekemeier | |
| 2015/0016874 | A1 | 1/2015 | Wandkowski et al. | |
| 2017/0292259 | A1 * | 10/2017 | Van Der Scheer | E03F 1/002 |
| 2020/0032500 | A1 | 1/2020 | Bhatia et al. | |
| 2022/0127833 | A1 * | 4/2022 | Kulick, III | E03F 1/005 |
| 2023/0167635 | A1 * | 6/2023 | Holbrook | E03F 1/005 210/170.03 |
| 2023/0212848 | A1 * | 7/2023 | Vitarelli | E03F 1/005 405/52 |
| 2023/0243142 | A1 * | 8/2023 | Miller | E03F 1/005 405/36 |

* cited by examiner

UNDERGROUND WATER TANKS USING MODULAR CRATES

RELATED APPLICATION

This application claims priority to provisional patent application U.S. Ser. No. 63/236,078 filed on Aug. 23, 2021, the entire contents of which is herein incorporated by reference.

BACKGROUND

The embodiments described herein relate generally to underground tanks and, more particularly, to crates that form the underground tanks that collect, detain, infiltrate, and store water, rainwater and/or storm water.

Underground tanks are used to collect, detain, infiltrate, and remove rainwater to clean and purify it for later use, such as for watering gardens, flushing toilets, washing machines and cars, agriculture, and for drinking, after further filtering, thereby conserving water and providing many economic and environmental benefits.

Underground modular crates can be formed from injected plastic to create crate modules, which are butted or stacked together to form the required tank size, wrapped in geotextile, and surrounded in good draining medium, such as sand. The geotextile material allows water to pass therethrough, but prevents any sand/fines from passing. Thus, water flows into the crates via a connecting pipe or infiltrates into them and percolates into the surrounding strata through the geotextile-covered openings of the assembled crate modules that create the underground tank. Similarly, water infiltrating through the soil above the crate enters the crates through the geotextile-covered top crates modules that form the tank.

Some existing underground tank modules use a large amount of plastic material and contain a small void volume, such that water flow through the modules is restricted. Others provide a large void volume for better flow of water through the modules, but have a considerably weak structure.

Therefore, what is needed is an improved crate module to create an underground tank, which would provide adequate void space and water flow through, as well as a strong supporting skeleton, wherein the improved crate module also includes structural reinforcement within the cavity/body of the crate modules.

SUMMARY

Some embodiments of the present disclosure include an underground infiltration crate for collecting, detaining, infiltrating, and removing rainwater and/or storm water. The underground infiltration crates may include a plurality of large plates attached to a plurality of small plates engaged to form a crate with tubular members positioned therein, wherein each tubular member is secured between a pair of large plates. Each of the large plates may be a framed panel that includes a four-sided periphery formed of a top periphery wall, a bottom periphery wall, and two side periphery walls; alternating parallel channels extending between the top periphery wall and the bottom periphery wall; at least one aperture extending through each of the alternating parallel channels; and at least one cylindrical adapter integrated into the framed panel, wherein the cylindrical built in fitting may be a ring-shaped groove that is sized to friction fit a tubular member therein. Other embodiments may include a cylindrical adapter attached to the framed panel in place of a built in fitting.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
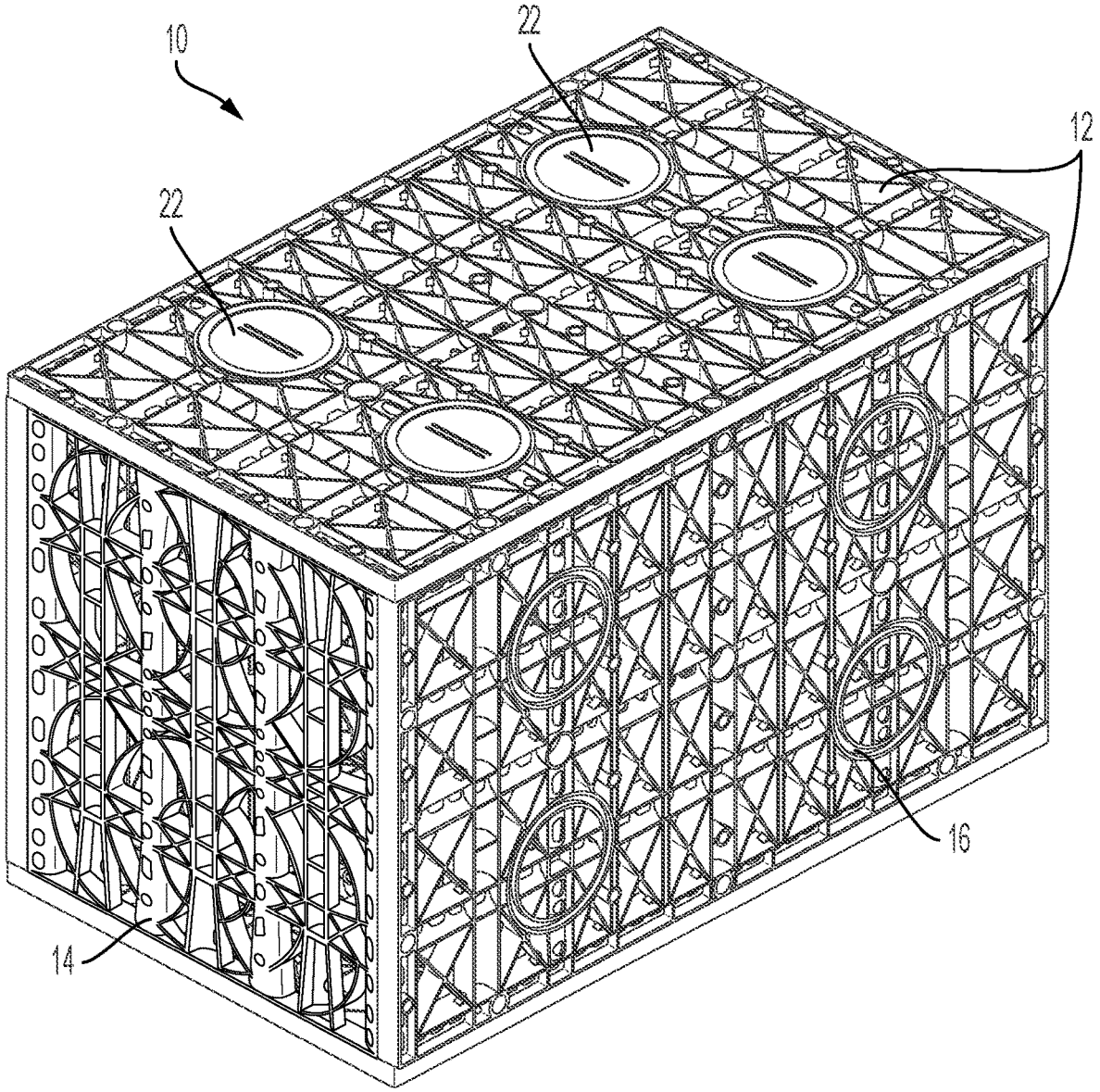
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as an improved crate module to create underground tanks that collect, detain, infiltrate, and remove storm water and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-5, some embodiments of the present disclosure include an underground infiltration crate 10 comprising a plurality of large plates 12, such as four large plates comprising a top plate, a bottom plate, and two side plates configured to be joined together to create a crate comprising a top, a bottom, a front, and a back; a plurality of small plates 14, such as a left panel, a right panel, and a medial panel, configured to connect to the plurality of large plates 12, wherein the plurality of plates are positioned to form a left wall, a right wall, and a medial interior wall in the crate. The underground filtration crate 10 may further comprise a plurality of pipes 18, such as four slotted pipes, positioned within the crate. For example, the plurality of pipes 18 may extend between the top plate and the bottom plate, wherein the plurality of pipes 30 are retained in, for example, a grid-like configuration.

Each of the plurality of large plates 12 and the plurality of small plates 14 may be updated versions of those shown in U.S. Pat. No. 8,123,436, the entire contents of which is herein incorporated by reference.

Figure 4:
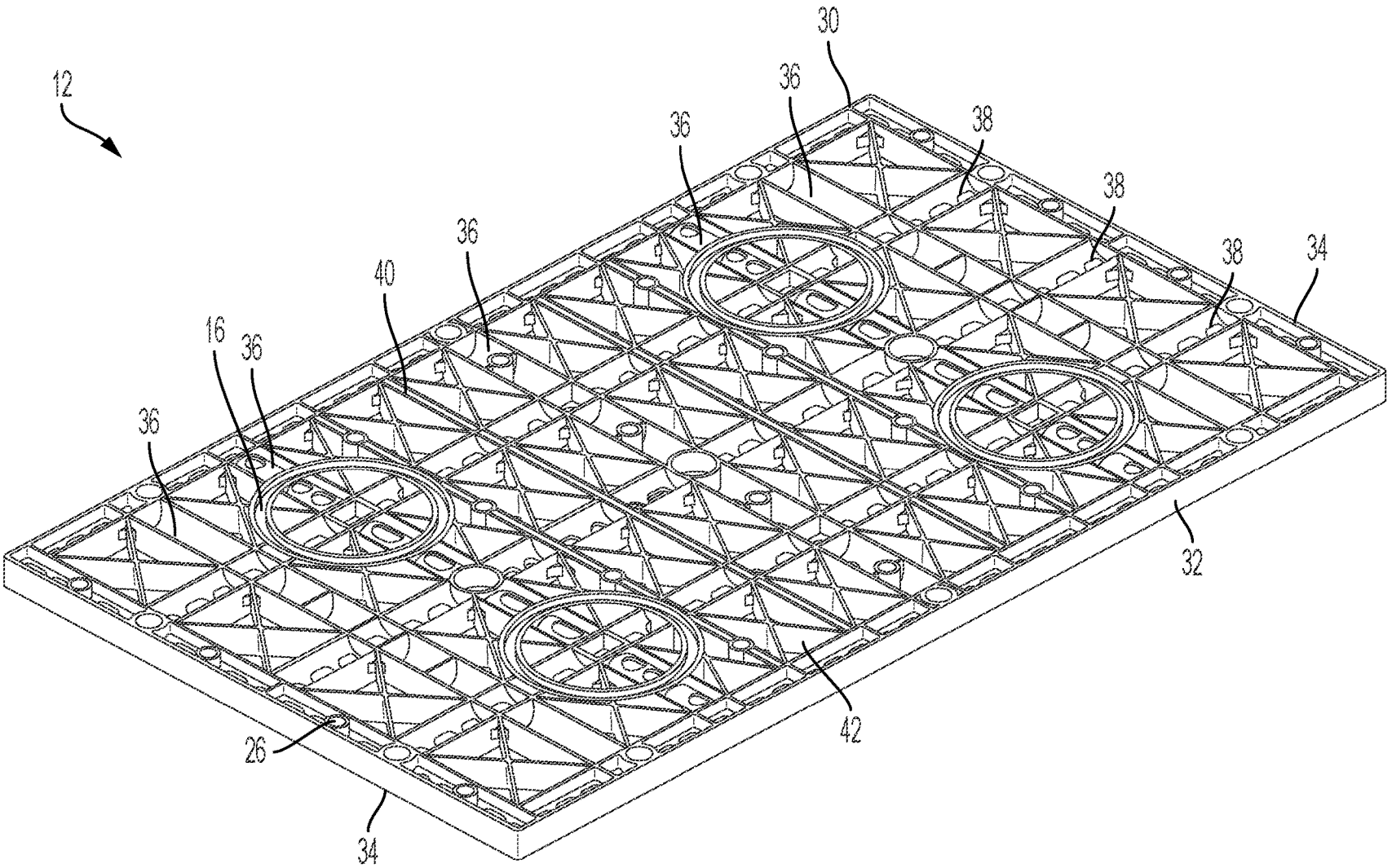
FIG. 4 is a perspective view of one embodiment of large side panel 12.

More specifically, and as shown in FIG. 4, embodiments of each large plate 12 of the plurality of large plates may comprise a framed panel designed to engage with and retain a plurality of tubular members or pipes 18 within integrated built in fitting recesses or ring shaped grooves 16, such that the large plate 12 is configured to accept tubular members or pipes 18 on either face of the plate. More specifically, each large plate 12 may comprise a four-sided periphery formed of a top periphery wall 30, a bottom periphery wall 32, and two side periphery walls 34. In embodiments, the large plate 12 may be substantially rectangular and, thus, the top periphery wall 30 may be substantially parallel to the bottom periphery wall 32, and the two side periphery walls 34 may also be substantially parallel to each other. Each of the two side periphery walls 34 may connect the top periphery wall 30 to the bottom periphery wall 32.

In embodiments, the framed panel may comprise a plurality of shorter channels 36, each of which may run from the top periphery wall 30 to the bottom periphery wall 32 and a plurality of longer channels 38 that run from a first of the pair of side walls 34 to a second of the pair of side walls 34. The shorter channels 36 may be separate from one another such that any part of one shorter channel 36 is not in contact with any part of another shorter channel 36. Similarly, the longer channels 38 may be separate from one another such that any part of one longer channel 38 is not in contact with any part of another longer channel 38. As shown in FIG. 4, the shorter channels 36 may be substantially perpendicular to the longer channels 38, thus forming a grid-like structure with a plurality of grid openings within the framed panel.

In embodiments, the shorter channels 36 may be arranged to alternately face in opposite directions, meaning that some may open toward a first face of the panel and others may open toward an opposite face of the panel. In some embodiments, the framed panel may comprise inner shorter channels and two end shorter channels, wherein the inner shorter channels may be located between the end shorter channels and may be substantially evenly spaced between the end shorter channels. Each of the inner shorter channels may be formed of a curved body and two flat sides, wherein the width of each of the flat sides of the inner shorter channels is preferably less than the width W of the side periphery wall 34. The curved body of the inner shorter channels may be integrally formed between the two flat sides, thus connecting the two flat sides.

As shown in FIG. 4, the framed panel of the large plate 12 may optionally further comprise a plurality of strut members 40 that extend between the top periphery wall 30 and the bottom periphery wall 32. These strut members 40 may run between channels and may intersect channels. Because the channels are separate from each other and because the strut members 40 run between the channels, numerous openings in the framed panel are provided. The strut members 40 may include strut members that are curved, strut members that run substantially parallel to the top periphery wall 30 and to the bottom periphery wall 32, and strut members 34 that run substantially diagonally relative to the side periphery walls 34. The framed panel may also include strut members 34 that run substantially parallel to the side periphery walls 34. Because the different types of strut members 34 run in different directions, the strut members 34 may meet or intersect each other at various locations in the framed panel. The different types of strut members 34 may also meet or intersect the channels.

In embodiments, and as shown in FIG. 4, an X-shaped support 42 may be positioned within each opening of the grid-like structure. The framed panel may further comprise one or more supporting web members, wherein the supporting web members may be formed at the intersections of two strut members and/or of a strut member and a channel by integrally adjoining them. In addition, a supporting web member may integrally adjoin an entire periphery defined by the intersecting strut members and channels. Further, supporting web members may be integrally and inwardly formed from the top periphery wall and from the bottom periphery wall. The use of supporting web members and X-shaped supports 42 may provide enhanced structural strength.

As shown in the Figures, the framed panel of the large plate 12 may further comprise holes or orifices formed within the channels, wherein each of the channels may comprise a plurality of orifices, such as orifices of at least two different shapes and sizes. The orifices may be formed in, for example, a curved body of each of the channels, wherein each of the channels may have different numbers of orifices.

In embodiments, a cylindrical built in fitting or ring-shaped groove 16 designed to securely accept a pipe 18 may extend into or be integrated into the interior framed panel structure of the large plate 12. More specifically, the ring shaped groove 16 may be integrated into the interior framed panel structure around at least one intersection of the shorter channels 36 and the longer channels 38. The ring shaped groove 16 may be sized such that an end of a pipe 18 is configured to friction fit therein, such that insertion of the pipe 18 into the ring shaped groove secures the pipe 18 to the framed panels. Moreover, a ring shaped groove 16 may be present on both faces of the framed panel, providing for pipe engagement from either side of the framed panel. While not shown in the drawings, other embodiments of the first plate 12 may comprise cylindrical adapters attached to the framed panel, wherein the cylindrical adapters are configured to securely hold the pipes 18.

As shown in the Figures, the framed panel may comprise a plurality of, such as four, ring shaped grooves 16 integrated on each face thereof, such that the framed panel may engage with and retain a plurality of, such as four, pipes 18 or tubular members. As shown in the Figures, the pipes 18 may be arranged in a grid-like fashion, wherein all of the pipes 18 run substantially parallel to one another.

Figure 5:
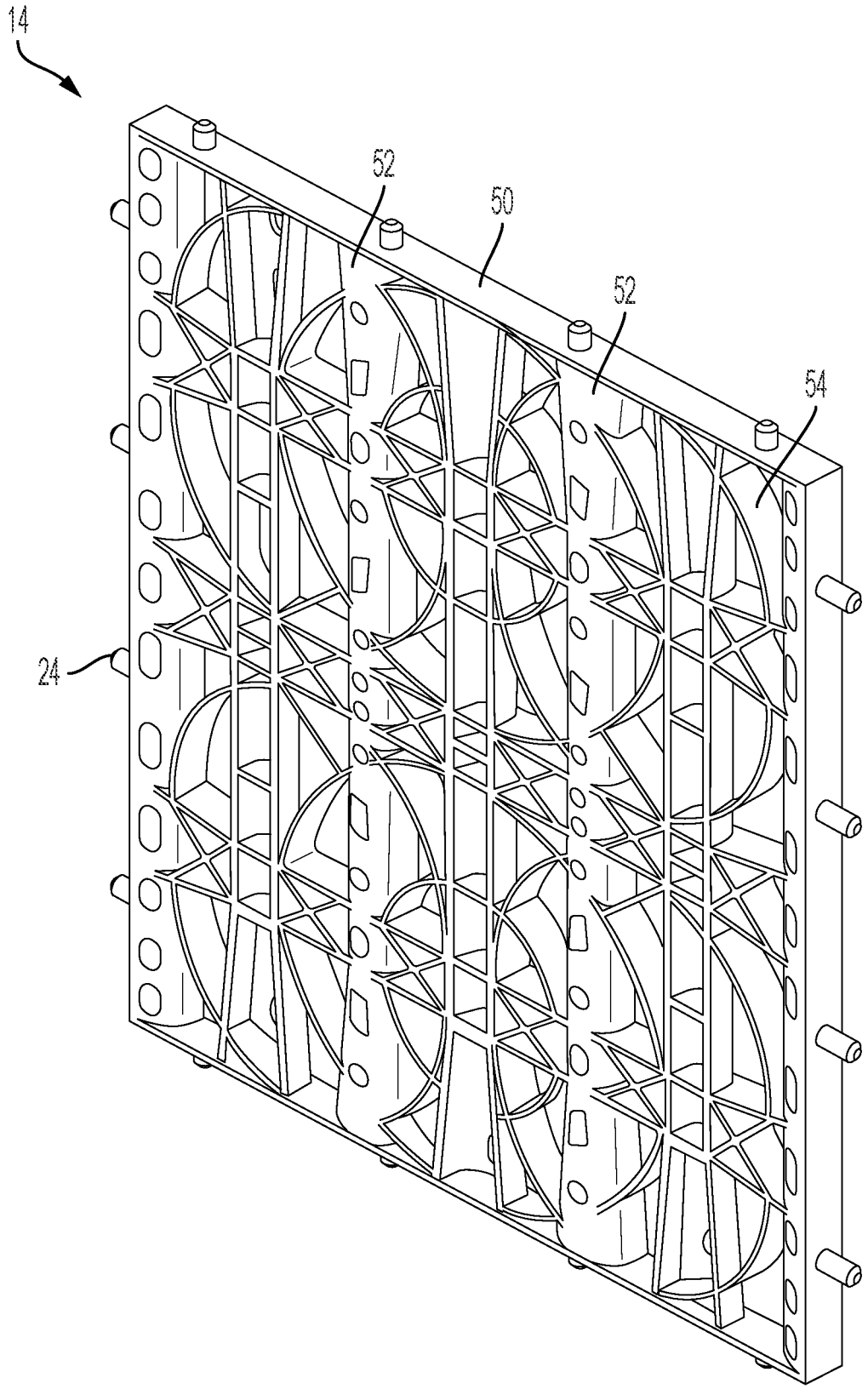
FIG. 5 is a perspective view of one embodiment of small side panel 14.

As mentioned above, the crate 10 may be formed from four of the large plates 12 along with three of the small plates 14. Similar to the large plates 12, the small plates 12 may each be a framed panel comprising four small plate periphery walls 50 connected in, for example, a square having a top edge, a bottom edge, and two side edges. A plurality of small panel channels 52 may run between each pair of opposite small plate periphery walls 50, thus forming a grid-like pattern. A plurality of small panel strut members 54 may run between the channels 52 and may intersect the channels 52. Because the channels 52 are separate from each other and the strut members 54 run between the channels 52, numerous openings in the framed panel are provided. The strut members 54 may include strut members that are curved, strut members that run substantially parallel to the top periphery wall and to the bottom periphery wall, and strut members that run substantially diagonally relative to the side periphery walls. The framed panel may also include strut members that run substantially parallel to the side periphery walls. Because the different types of strut members run in different directions, the strut members may meet or intersect each other at various locations in the framed panel. The different types of struts may also meet or intersect the channels. In some embodiments, the different types of strut members may be arranged to generally provide a plurality of strut members 54 generally forming a plurality of circles through intersecting all of the inner channels and abutting the end channels, as shown in FIG. 5. Thus, in embodiments, the small plates 14 may have a structure similar to the large plates 12 without the ring-shaped grooves 16.

As mentioned above, the crate 10 may be formed by the joining of four large plates 12 and three small plates 14. In some embodiments, the joining may be achieved by engaging a peg 24 extending from a periphery wall of the small plate 14 with a notch 26 extending into a periphery wall of the large plate 10. In fact, the small plate 14 may comprise a plurality of pegs 24 extending therefrom and the large plate 12 may comprise a plurality of notches 26 extending therein, wherein engaging the pegs 24 with the notches 26 may secured the large plates 12 and the small plates 14 together. However, in other embodiments, the small plates may comprise the notches and the large plates may comprise the pegs.

As mentioned above, the crate 10 may comprise a plurality, such as four, pipes 18 or tubular members mounted therein, wherein a first end of each pipe 18 is engaged with a first large plate 12 and a second end of each pipe 18 is engaged with a second large plate 12 opposite the first large plate 12. Thus, pipes 18 may be positioned in a grid fashion and extend between the bottom large plate and the top large plate, and an additional four pipes 18 may extend from an outer surface of the top plate, wherein the pipes 18 on either side of the top plate may align with one another. As such, the top plate may have ring-shaped grooves 16 on each larger planar surface thereof. While the use of pipes 18 in grids of four is shown in the Figures, the use of varying numbers of pipes is envisioned. Moreover, the device of the present disclosure may further comprise a lid 22 removably attached to outer surfaces of the large plates 12, and particularly to the bottom plate, wherein the lid 22 may help with weight dispersion and may prevent the pipes 18 from punching through the bottom plate. More specifically, as shown in the Figures, the lids 22 may each be substantially disc-shaped, wherein a bottom surface thereof may comprise a ring-shaped lip designed to removably engage with the ring-shaped grooves 16 in the large plates 12.

Figure 2:
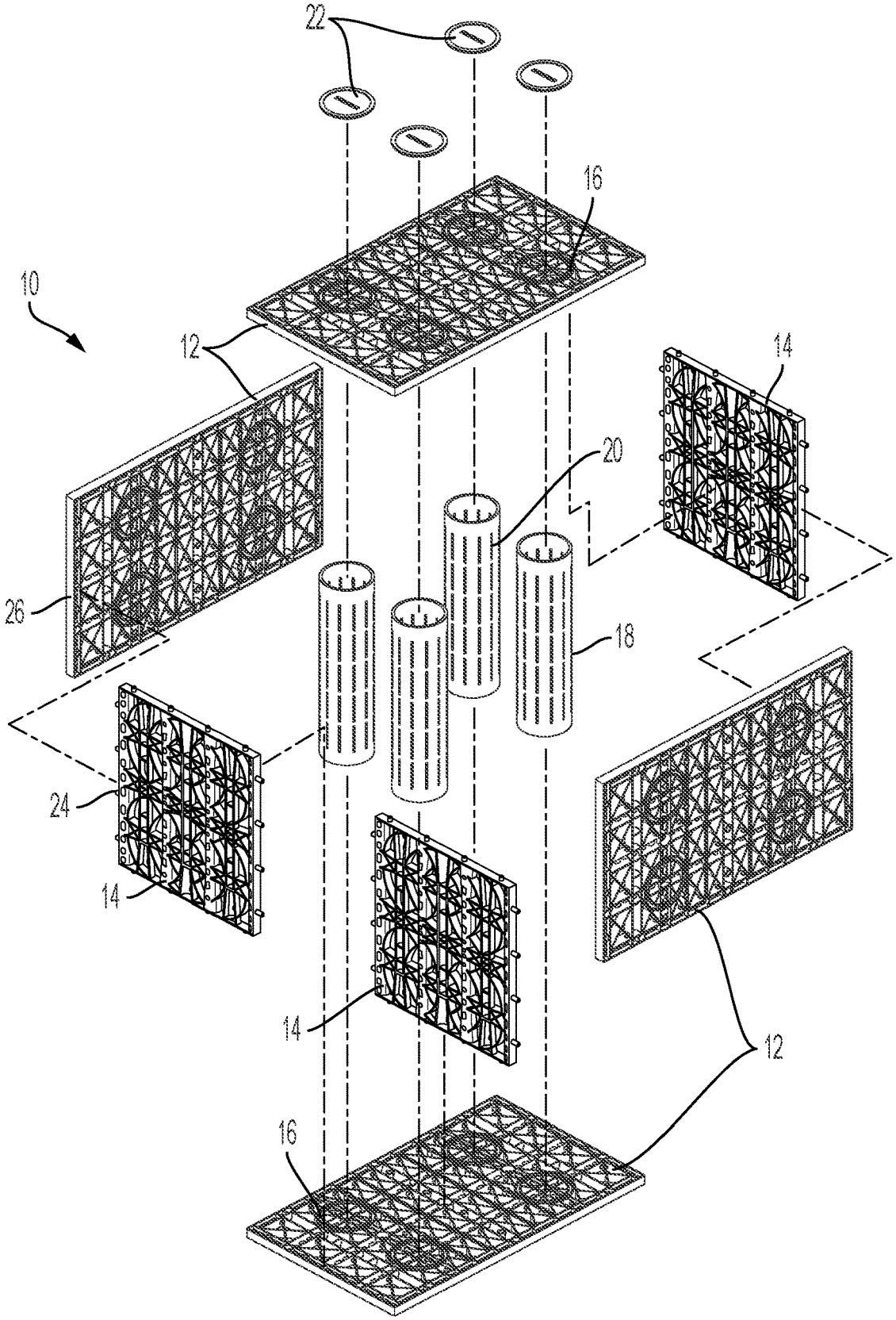
FIG. 2 is an exploded perspective view of one embodiment of the present disclosure.
Figure 3:
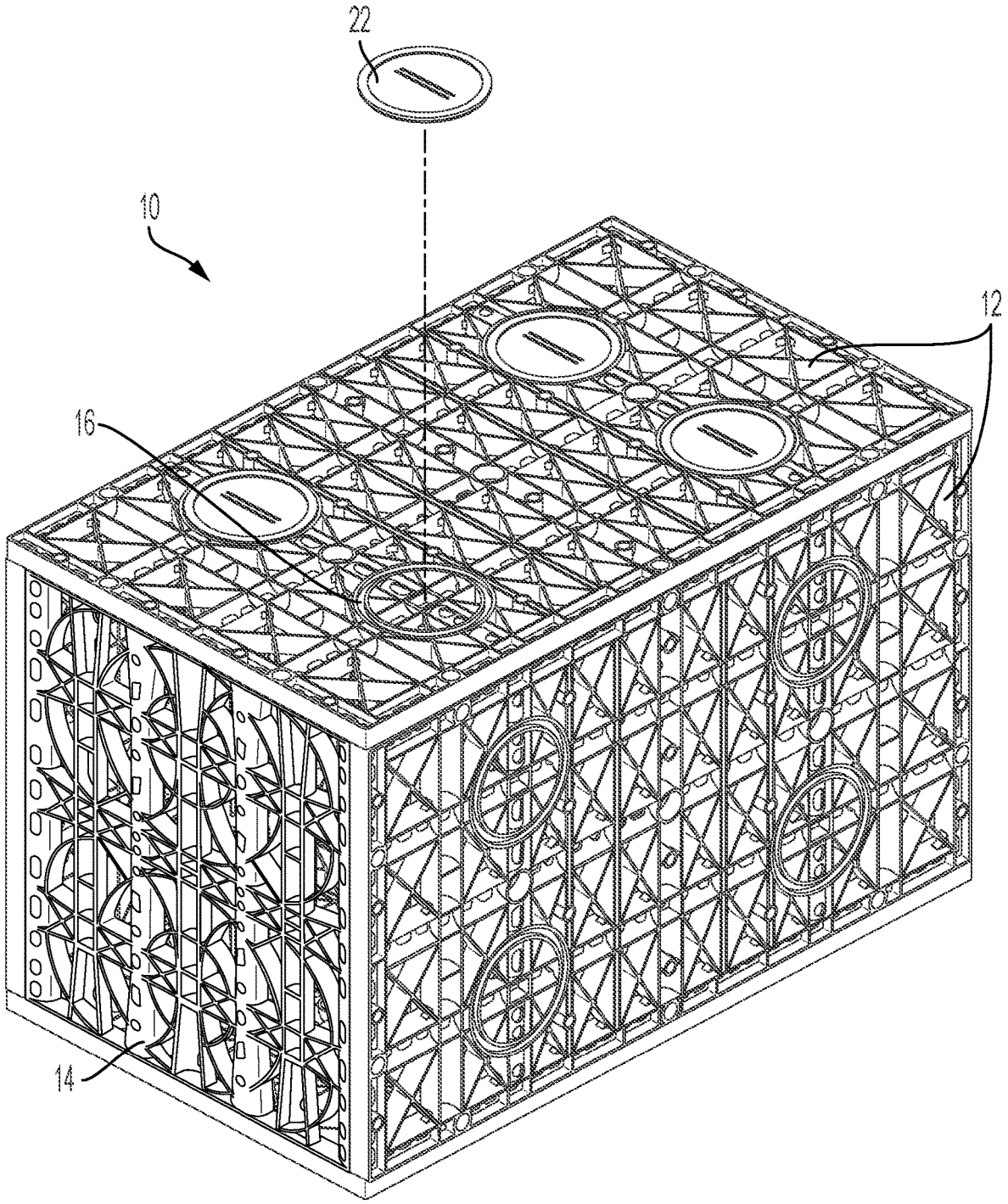
FIG. 3 is a perspective view of one embodiment of the present disclosure with lid 16 exploded off.

In embodiments, the pipes 18 may comprise tubular members with a substantially cylindrical shape. As shown in FIG. 2, each of the pipes 18 may have a plurality of slits 20 extending therethrough. The pipes 30 may be made of any suitable or desirable materials, such as plastic, steel, concrete, or any other suitable material for increasing the load bearing lidability of the crates.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. An underground infiltration crate for collecting, detaining, infiltrating, and storing grey water, rainwater, and/or storm water, the underground filtration crate comprising:

a plurality of large plates;

a plurality of small plates engaged with the plurality of large plates to form a crate having a top, a bottom, a front, a back, a left wall, a right wall, and a medial interior wall; and a plurality of tubular members positioned within the crate, each tubular member of the plurality of tubular members secured between a pair of large plates, wherein each large plate of the plurality of large plates comprises:

a framed panel designed to engage with and retain the plurality of tubular members within built in fittings, wherein the framed panel comprises:

a four-sided periphery formed of a top periphery wall, a bottom periphery wall, and two side periphery walls;

alternating parallel channels extending between the top periphery wall and the bottom periphery wall;

at least one aperture extending through each of the alternating parallel channels; and at least one built in fitting integrated into the framed panel, wherein:

the framed panel is substantially planar with a front face and a back face;

the at least one built in fitting comprises a ring-shaped groove that is sized to friction fit a tubular member from the plurality of tubular members therein;

each of the front face and the back face comprises at least one built in fitting;

the alternating parallel channels comprise a plurality of shorter channels;

the framed panel further comprises a plurality of longer channels extending from a first side wall of the two periphery side walls to a second side wall of the two periphery side walls; and the plurality of shorter channels are perpendicular to the plurality of longer channels, forming a grid-like structure with a plurality of grid openings.

2. The underground infiltration crate of claim 1, wherein the plurality of tubular members comprises four tubular members arranged in a grid fashion between the top and the bottom of the crate.

3. The underground infiltration crate of claim 1, wherein:

the plurality of large plates comprises four large plates, which correspond with the top, the bottom, the front, and the back of the crate; and the plurality of small plates comprises three small plates, which correspond with the left wall, the right wall, and the medial interior wall of the crate.

4. The underground infiltration crate of claim 1, wherein the framed panel further comprises an X-shaped support positioned within each grid opening.

5. The underground infiltration crate of claim 1, wherein each tubular member of the plurality of tubular members comprises a hollow cylinder member with an open bottom, an open top, and a plurality of slits extending through the cylinder member.

6. The underground infiltration crate of claim 1, further comprising at least one lid removably engaged with at least one of the built in fittings.

7. An underground infiltration crate for collecting, detaining, infiltrating, and storing grey water, rainwater, and/or storm water, the underground filtration crate comprising:

a plurality of large plates;

a plurality of small plates engaged with the plurality of large plates to form a crate having a top, a bottom, a front, a back, a left wall, a right wall, and a medial interior wall; and a plurality of tubular members positioned within the crate, each tubular member of the plurality of tubular members secured between a pair of large plates, wherein each large plate of the plurality of large plates comprises:

a framed panel designed to engage with and retain the plurality of tubular members within built in fittings, wherein the framed panel comprises:

a four-sided periphery formed of a top periphery wall, a bottom periphery wall, and two side periphery walls;

alternating parallel channels extending between the top periphery wall and the bottom periphery wall;

at least one aperture extending through each of the alternating parallel channels; and at least one built in fitting integrated into the framed panel, wherein:

the framed panel is substantially planar with a front face and a back face;

the at least one built in fitting comprises a ring-shaped groove that is sized to friction fit a tubular member from the plurality of tubular members therein;

each of the front face and the back face comprises at least one built in fitting; and each tubular member of the plurality of tubular members comprises a hollow cylinder member with an open bottom, an open top, and a plurality of slits extending through the cylinder member.

8. An underground infiltration crate for collecting, detaining, infiltrating, and storing grey water, rainwater, and/or storm water, the underground filtration crate comprising:

a plurality of large plates;

a plurality of small plates engaged with the plurality of large plates to form a crate having a top, a bottom, a front, a back, a left wall, a right wall, and a medial interior wall; and a plurality of tubular members positioned within the crate, each tubular member of the plurality of tubular members secured between a pair of large plates, wherein each large plate of the plurality of large plates comprises:

a framed panel designed to engage with and retain the plurality of tubular members within built in fittings, wherein the framed panel comprises:

a four-sided periphery formed of a top periphery wall, a bottom periphery wall, and two side periphery walls;

alternating parallel channels extending between the top periphery wall and the bottom periphery wall;

at least one aperture extending through each of the alternating parallel channels;

at least one built in fitting integrated into the framed panel; and at least one lid removably engaged with at least one of the at least one built in fittings, wherein:

the framed panel is substantially planar with a front face and a back face;

the at least one built in fitting comprises a ring-shaped groove that is sized to friction fit a tubular member from the plurality of tubular members therein; and each of the front face and the back face comprises at least one built in fitting.

* * * * *